United States Patent [19]

Aoyama

[11] 4,357,917

[45] Nov. 9, 1982

[54] VARIABLE VALVE TIMING SYSTEM FOR INDUCTION CONTROL OF AN INTERNAL COMBUSTION ENGINE

[75] Inventor: Shunichi Aoyama, Yokohama, Japan

[73] Assignee: Nissan Motor Company, Limited, Yokohama, Japan

[21] Appl. No.: 37,351

[22] Filed: May 9, 1979

[30] Foreign Application Priority Data

May 15, 1978 [JP] Japan ..... 53/578140

[51] Int. Cl.[3] ..... F01L 1/34

[52] U.S. Cl. ..... 123/90.16; 123/90.12; 123/90.55; 123/348; 123/389; 123/568

[58] Field of Search ..... 123/90.12, 90.14, 90.15, 123/90.16, 90.20, 90.27, 90.31, 90.48, 90.52, 90.55, 90.56, 90.57, 90.58, 568, 389, 344, 347, 348; 251/57

[56] References Cited

U.S. PATENT DOCUMENTS

| | | | |
|---|---|---|---|
| 2,804,061 | 8/1957 | Gamble | 123/90.15 |
| 2,851,851 | 9/1958 | Smith | 123/90.15 |
| 3,416,502 | 12/1968 | Weiss . | |
| 3,897,760 | 8/1975 | Hisserich | 123/90.16 |
| 4,022,175 | 5/1977 | Laprade et al. | 123/568 |
| 4,033,304 | 7/1977 | Luria | 123/90.12 |
| 4,046,117 | 9/1977 | Brinlee | 123/389 |
| 4,114,576 | 9/1978 | Goto et al. | 123/568 |

FOREIGN PATENT DOCUMENTS

| | | |
|---|---|---|
| 109380 | 1/1940 | Australia . |
| 158214 | 8/1954 | Australia . |
| 57301 | 1/1971 | Australia . |
| 506837 | 1/1980 | Australia . |

*Primary Examiner*—Craig R. Feinberg
*Assistant Examiner*—W. R. Wolfe

[57] ABSTRACT

The present invention relates to a variable valve timing system for an internal combustion engine which cyclically opens and closes a port providing fluid communication between a combustion chamber and a conduit leading thereto and which delays the closure of the port in response to a signal indicative of the power output required of the engine in order to vary the ratio of the mass of fluid inducted into the chamber to the mass of fluid expelled from said chamber during the period the port is open so that the mass of fluid retained in the chamber after closure of the port can be controlled without the use of a throttle valve.

16 Claims, 11 Drawing Figures

VARIABLE VALVE TIMING SYSTEM FOR INDUCTION CONTROL OF AN INTERNAL COMBUSTION ENGINE

FIELD OF THE INVENTION

The present invention relates to an internal combustion engine and more particularly to a method and apparatus for controlling the induction of said engine.

BACKGROUND OF THE INVENTION

One major problem plaguing internal combustion engines is the so-called pumping loss which occurs during part throttle operation of the engine.

When an internal combustion engine operates at part throttle, a vacuum is developed downstream of the throttle valve. This negative pressure is transmitted to the combustion chamber of the engine during the induction phase of operation thereof. This tends to resist the movement of the piston, in the case of a reciprocating type internal combustion engine, in the direction of bottom dead center (BDC) due to the pressures differential developed across the piston. As a result some of the power developed during the power stroke of the piston is wasted in drawing the piston against the vacuum prevailing in the combustion chamber during the induction stroke thereof.

In order to partially overcome this pumping loss problem, a number of so-called "split mode" operation engines have been proposed wherein during part throttle operation, such as cruising and deceleration, some of the cylinders are disabled. However these arrangements, while partially solving the problem have encountered other drawbacks in the form of jolting induced by the sudden torque output changes occurring upon abling and disabling of one or more of the cylinders. Moreover the undue complexity of workable arrangements tends to be prohibitive.

Hence there still exists the need for an arrangement which can completely eliminate the pumping loss problem.

SUMMARY OF THE INVENTION

A first important aspect of the present invention comes in the combination of an internal combustion engine having a combustion chamber which undergoes a volume expansion during one phase of engine operation and contraction during a second phase of operation with an apparatus which opens a port of the chamber during one of said phases and a period overlapping a portion of the other and which varies the period for which the port is open to vary the mass of fluid confined in the chamber.

A second important aspect of the invention comes in a method of operating an internal combustion engine wherein a full charge of fluid is inducted into the combustion chamber during one phase of operation of the engine and a portion of the change is discharged or expelled from the chamber during a second phase of operation wherein by controlling the amount of fluid discharged the mass of the fluid retained in the chamber can be controlled.

A third important aspect of the present invention comes in the use of a valve actuating apparatus wherein two cams which normally rotate with a given phase difference therebetween are used to reciprocate hydraulic pistons which cooperate to pressurize hydraulic fluid in a cylinder which in turn is used to reciprocate a third piston drivingly connected to a valve. The apparatus also includes an arrangement for varying the phase difference between the cams to vary the period for which the third piston moves the valve.

A further important aspect of the present invention comes in the use of intermeshing helical gears which when moved axially with respect to each other induce an angular displacement therebetween in addition to the rotation to rotation translation normally provided.

Thus, by way of example, it is possible to control the induction of a combustible charge into the combustion chamber of the engine without the use of a throttle valve and with substantially atmospheric pressure in the induction passage or manifold, by inducting a full charge into the chamber during the induction phase and discharging a controlled portion of said charge back into the induction passage during the initial stage of the compression phase.

It will thus be understood that with the present invention the pumping loss problem can be completely solved.

In the case it is desired to employ so-called "external" EGR (exhaust gas recirculation) it is advantageous to provide means by which a predetermined low vacuum can be maintained in the induction passage for facilitating the induction of the exhaust gases from the exhaust conduit or manifold. It is further advantageous to disable the above-mentioned means during given modes of engine operation to obviate the vacuum thus facilitating the cessation of the EGR.

Further it is not outside the scope of the present invention for use in the case of "internal" EGR wherein exhaust gases are inducted from the exhaust conduit into the combustion chamber via the exhaust valve.

BRIEF DESCRIPTION OF THE DRAWINGS

The above and many other aspects, features and advantages of the present invention will become more deeply appreciated as the description of the preferred embodiments is made in conjunction with the attached drawings, in which.

DETAILED DESCRIPTION OF THE PREFERRED EMBODIMENT

Figure 1:
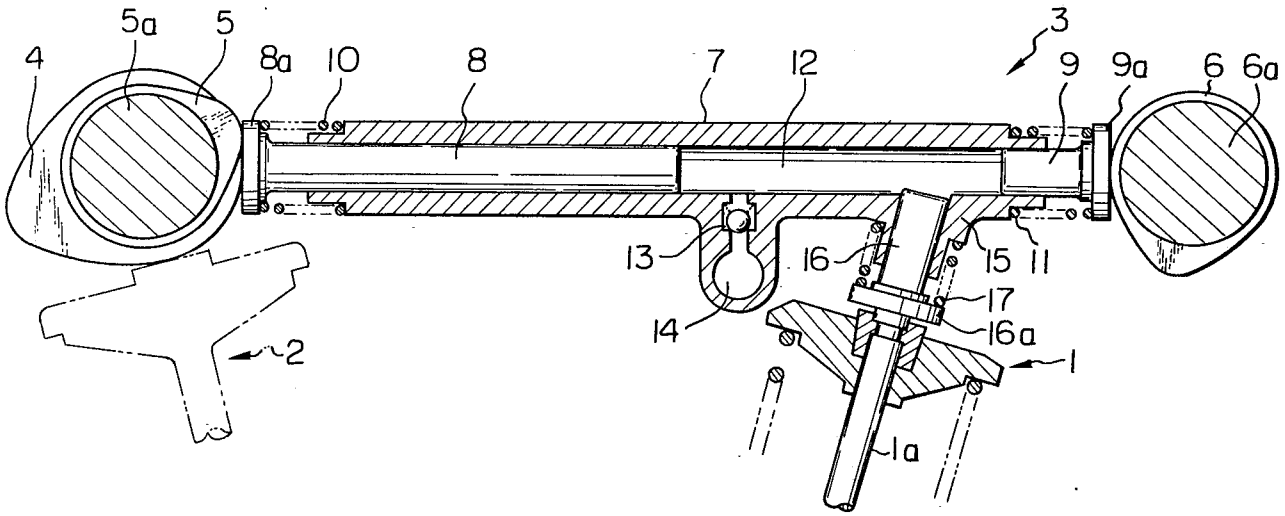
FIG. 1 is a sectional view of a hydraulic valve actuating device which forms a part of the preferred embodiment of the present invention.

FIG. 1 of the drawings shows a hydraulic valve lifting arrangement 3 of the preferred embodiment of the present invention. With this arrangement two cam shafts 5*a* and 6*a*, which by way of example take the form of a twin overhead cam arrangement, carry cams for operating the inlet valve 1 and the exhaust valve 2. In this embodiment the cam shaft 5*a* carries two sets of cams, tht is cams 4 and 5. As shown the cam 4 induces reciprocation of the exhaust valve 2 while the cam 5 induces reciprocation of a piston 8 via engagement with a tappet portion 8*a* formed on the end of the piston. As shown the piston 8 is reciprocatively received in an elongate cylinder 7 and biased by biasing means in the form of a spring 10 toward the cam shaft 5*a* so that the tappet portion 8*a* remains in sliding contact with the contoured surface of the cam 5. A second piston 9 is received reciprocatively in the cylinder 7 as shown. This piston has a tappet portion 9*a* which is similar to the tappet portion 8*a*, and which is maintained in sliding contact with the contoured surface of the cam 6 by spring 11. A third piston 16 is reciprocatively received in a branch like portion 15 of the cylinder 7. This third piston is subject to the bias of a spring 17 which maintains the tappet portion 16*a* thereof in contact with the top of the valve stem 1*a*. The common chamber 12 defined within the cylinder 7 is filled with hydraulic fluid supplied from a hydraulic fluid gallery 14 via a check valve 13.

Figure 2:
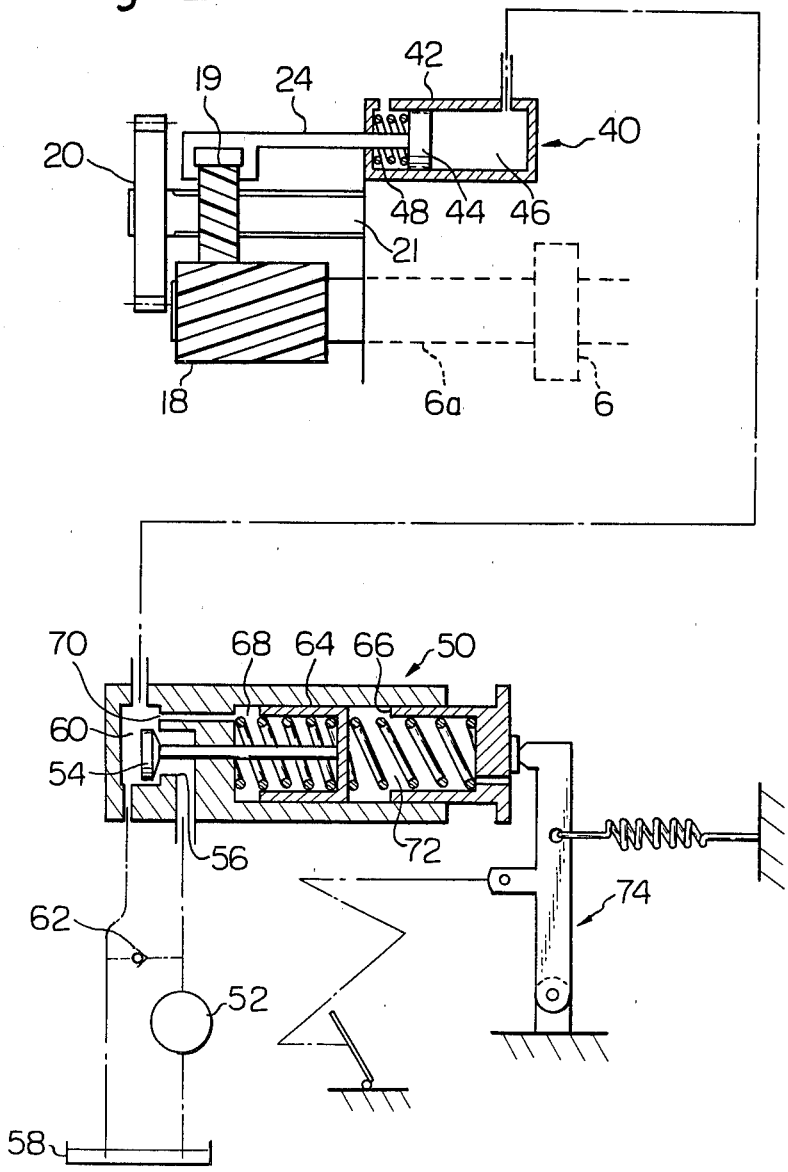
FIG. 2 is a schematic view of a pressure proportioning valve and helical gearing which varies the phasing between the cams shown in FIG. 1.

Looking now to FIG. 2 we find an arrangement for varying the angular position or phase of cam 6 with respect to cam 5 in response to a demand signal generated in accordance with a demand for a given power output by the internal combustion engine. As shown cam shaft 6*a* carries a helical gear 18 at one end thereof which is in meshing engagement with a second helical gear 19. The helical gear 19 is slidably received on a rotary shaft 21 and connected thereto via suitable means, which in this case takes the form of splines, for synchronous rotation therewith. Connected to one end of the rotary shaft is a sprocket 20 or similar pulley which is chain or belt driven. Further disclosure to this sprocket will be made later in this disclosure.

A shift fork 24 is operatively arranged with the helical gear 19 so that the gear may be moved along the shaft 21. A power cylinder arrangement 40 is operatively connected to the shift fork 24. This arrangement consists of a cylinder 42 in which a piston 44 is slidably received to define a variable volume hydraulic chamber 46. The piston is connected to the shift fork 24 and biased in a direction against the hydraulic pressure prevailing in the chamber 46 by a spring 48. With this arrangement as the pressure in the chamber 46 decreases the spring will bias the piston and shift fork 24 in a direction to move the helical gear 19 to the right (as seen in the figure) and vice versa. It will be appreciated that as the helical gear 19 is moved axially along the helical gear 18 a positive angular displacement between the rotary shaft 21 and the cam shaft 6*a* occurs in addition to the rotation to rotation translation normally provided between the meshing gears. Hence for any given relative axial movement between the two helical gears 18 and 19 a corresponding change in phase or angular position between the cams 5 and 6 will occur. This will be made clearer with reference to FIG. 3 of the drawings.

In order to readily control the pressure prevailing in the hydraulic chamber 46 a pressure proportioning valve 50 is provided. The function of this valve is to proportion the degree of pressure permitted to be transmitted from a pump 52 to the chamber 46. As shown the proportioning valve 50 has a valve member 54 which is movable with respect to a valve seat 56 so as to variable restrict the flow of pressurized hydraulic fluid from the pump therepast. As shown the chamber 46 and a sump 58 from which the pump 52 draws hydraulic fluid fluidly communicate with a valve chamber 60 located downstream of the valve seat 56. A relief valve 62 interconnects the feed line interconnecting the pump and the proportioning valve and the drain line interconnecting the proportioning valve and the sump. Hence upon a predetermined pressure prevailing in the feed line as will occur when the valve member 54 seats on the valve seat 56 hydraulic fluid will be relieved through the valve 62 back to the sump 58.

The proportioning valve 50 has a bore formed therein in which two pistons 64 and 66 are reciprocatively disposed. The first piston 64 defines a variable volume hydraulic chamber 68 in said bore. As shown the chamber 68 is communicated with the valve chamber 60 via a small diameter passage 70. The second piston is received in the open end of the bore to define an atmospheric chamber 72. The second piston 66 has a small diameter through bore (no numeral) formed therein to establish constant communication between said atmospheric chamber 72 and the atmosphere. Springs (no numerals) are disposed in hydraulic chamber 68 and the atmospheric chamber respectively. A lever arrangement generally denoted by the numeral 74 is operatively connected to the accelerator pedal of the vehicle to which the variable valve timing system according to the present invention is provided. This lever is arranged to urge the piston 66 against the bias of the spring disposed in the atmospheric chamber 72 to in turn apply a load to the first piston 68 in response to an increase in the magnitude of the demand signal. However the generation of this signal is not limited to the movement or depression of the previously mentioned accelerator pedal and may be generated by other suitable means. As shown the first piston is fixedly connected to the valve member 54. Thus if the accelerator pedal is depressed the piston and spring arrangement will tend to open the valve 50 to permit an increased hydraulic pressure to prevail in the hydraulic chamber 46. This increased pressure will also be transmitted to the hydraulic chamber 68 of the proportioning valve. An equilibrium is therefor established between the piston and spring arrangement and the pressure in the chamber 68.

With the just described arrangement upon depression of the accelerator pedal the pressure in the hydraulic chamber 46 increases driving the helical gear 19 toward the left (as seen in the drawings). It is to be noted however, that any other suitable mechanical hydraulic or electrical arrangement for achieving the just mentioned movement of the helical gear falls within the perview of the present invention and accordingly can be substituted for the just described arrangement.

Figure 3:
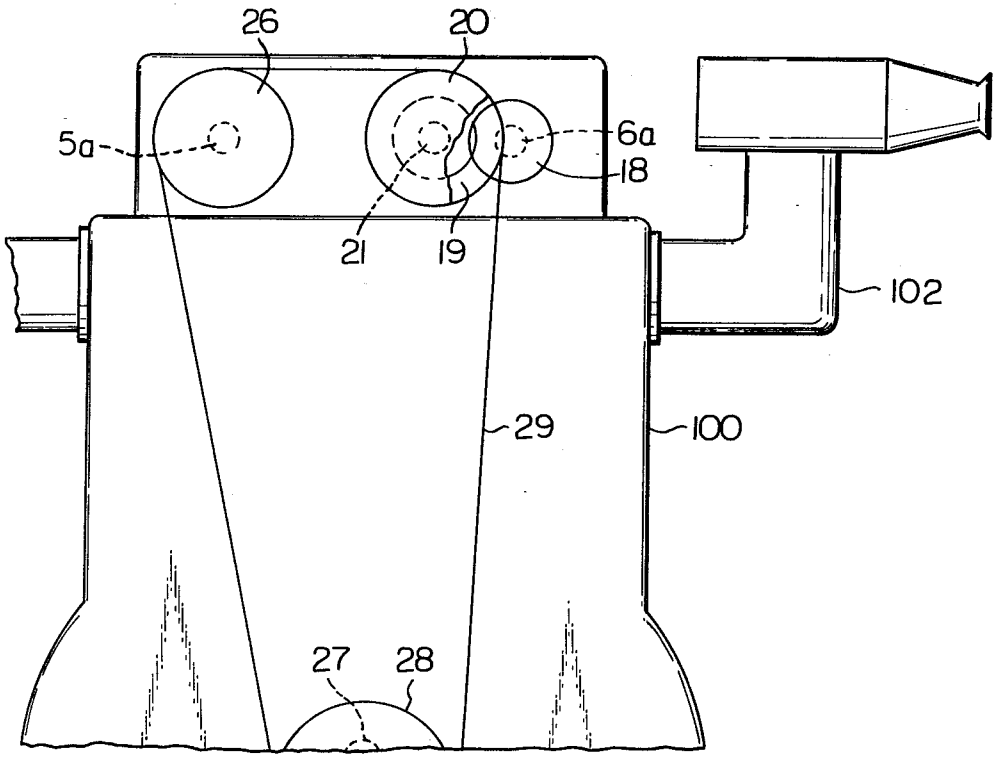
FIG. 3 schematically shows an end elevation of internal combustion engine equipped with the variable valve timing system according to the present invention and depicts the connection between a sprocket driven by the crankshaft of the engine and the sprockets of the variable valve timing system.

Turning now to FIG. 3 of the drawings we find a schematic representation of an internal combustion engine 100 which is equipped with the preferred embodiment of the present invention. As shown the cam shaft 5*a* and shaft 21 are equipped with sprockets or pulleys 26 and 20 respectively. The connection between the shaft 21 and the cam shaft 6*a* has already been set forth.

A chain 29 or suitable belt is provided about sprockets 26 and 20 and arranged in drive connection with the crankshaft 27 of the engine through suitable means such as a sprocket 28. Hence both sprockets 26 and 20 rotate in synchronism with crankshaft of the engine. Preferably for ease of manufacture and design the sprockets 20 and 26 are of the same diameter (with the same number of teeth) and the meshing helical gears are likewise so selected that the cam shaft 6*a* rotates at the same rotational speed as the cam shaft 5*a*.

Figure 5:
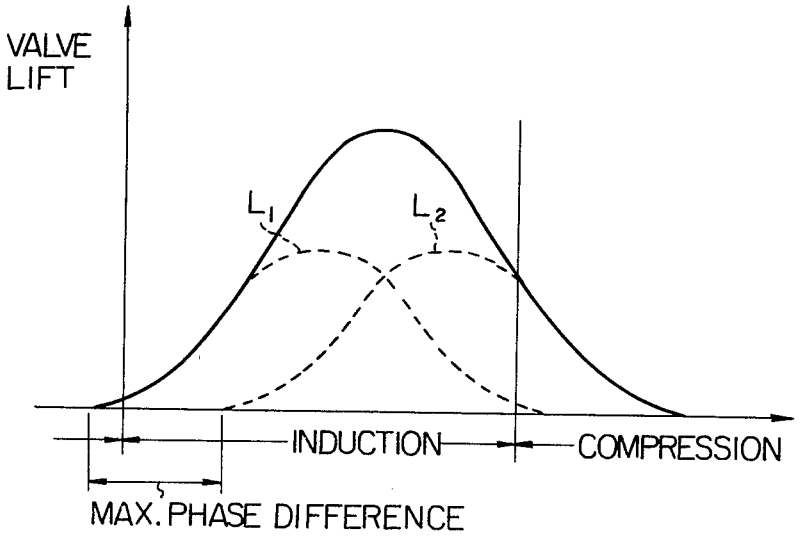

Referring once more to FIG. 1 of the drawings it will be understood that when the demand for power is minimal viz. the accelerator pedal is not depressed, that the cams 5 and 6 rotate with the maximum phase difference therebetween. This of course induces the maximum duration of pressure generation within the cylinder 7 whereby the lift of the inlet valve is such that the valve remains open for the maximum of a predetermined period into the compression stroke. This situation can be best understood from FIG. 5 wherein the broken lines indicate the individual lifts $L_1$ and $L_2$ provided by pistons 8 and 9 respectively and the solid line curve indicates the addition of the individual lifts and indicates the actual or resultant lift of the inlet valve.

Figure 4:
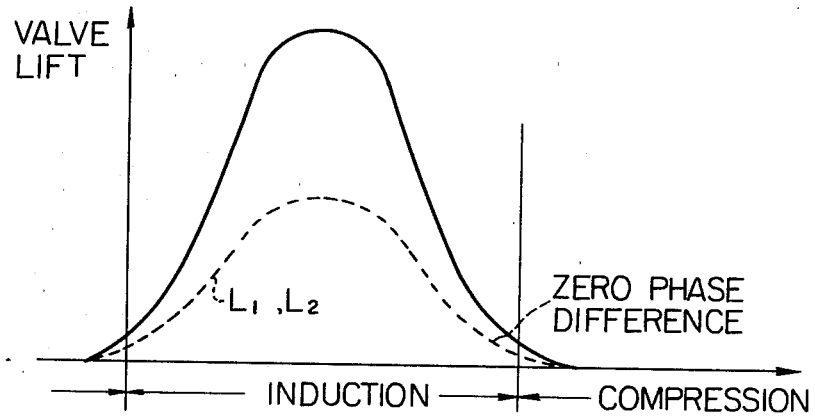
FIG. 4 and FIG. 5 are graphs showing the valve lift of the inlet valve which occurs when there is zero phase difference between the cams shown in FIG. 1 and a given phase difference between said cams, respectively.

Thus as the accelerator is depressed the phase difference between the cams 5 and 6 tends to zero whereupon the pistons 8 and 9 tend to reciprocate toward each other simultaneously. Maximum pressure of minimum duration tends to be generated inducing the piston 16 to undergo maximum lit and minimum overlap of the compression stroke. This situation is clearly depicted in FIG. 4 of the drawings.

Thus as the demand for power increases viz. as the accelerator pedal is depressed the amount of combustible charge discharged back into the induction manifold reduces thereby increasing the mass of charge retained in the combustion chamber at the point of ignition. At full depression of the accelerator pedal the same effect as wide open throttle operation occurs viz, the maximum amount of charging of air and/or air-fuel mixture into the combustion chamber occurs. However throughout all of the operation of the engine it will be appreciated that atmospheric or close to atmospheric pressure will prevail within the induction manifold eliminating any work necessary to draw air around a partially closed throttle valve and eliminating the retardation of the movement of the piston (in the case of a reciprocating type internal combustion engine) toward BDC due to the presence of a partial vacuum during stroking thereof.

Figure 6:
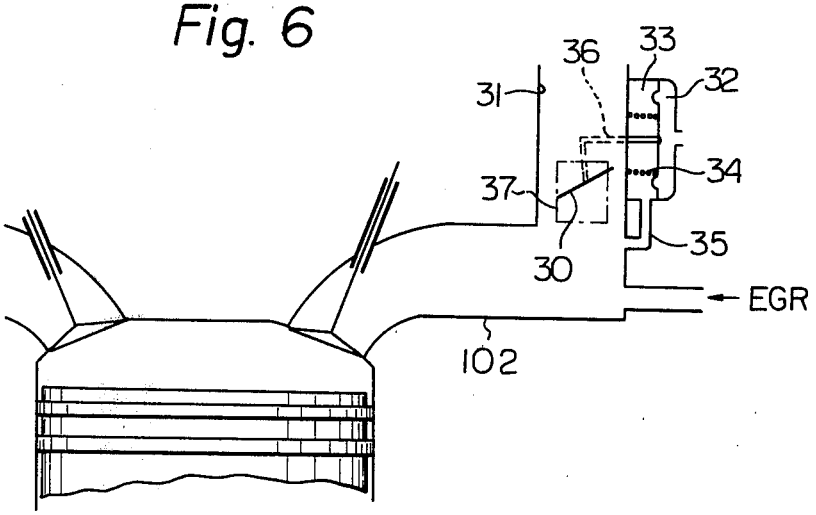
FIG. 6 shows a throttle valve arrangement for maintaining a predetermined vacuum within the induction manifold which facilitates the recirculation of exhaust gas from the exhaust conduit to said induction manifold.
Figure 7:
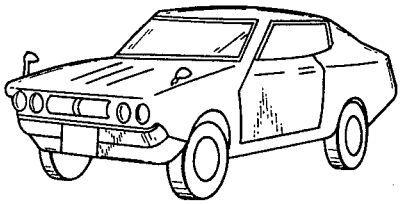
FIG. 7 is a perspective view of a vehicle equipped with an internal combustion engine having a variable valve timing system according to the present invention.
Figure 8:
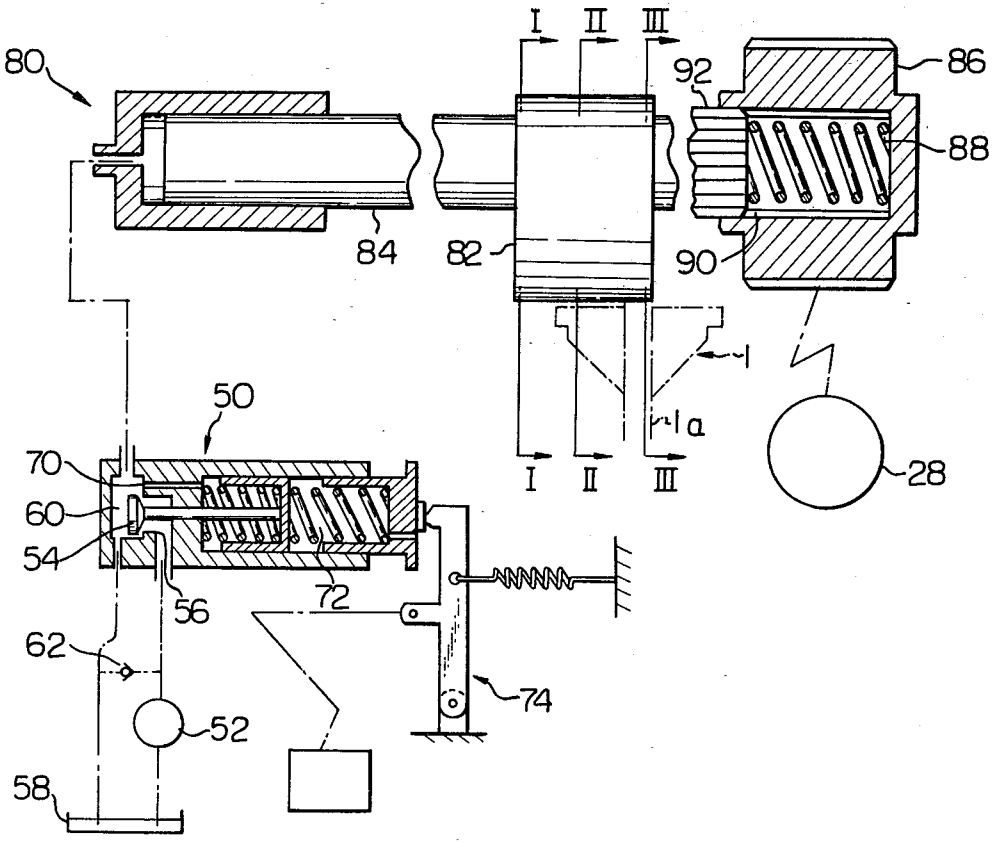
FIG. 8 is a schematic sketch of a second embodiment of the present invention.

However in the case it is desired to recirculate exhaust gases from the exhaust manifold to the induction manifold it is preferable to create a predetermined vacuum within the induction manifold. This vacuum may be of the order of −100 mmHg within the induction manifold. Thus, to this end it is possible to dispose a throttle valve 30 or the like in the passage leading to the induction manifold of the engine. This arrangement is clearly shown in FIG. 6 of the drawings. As seen a vacuum motor for controlling the throttle valve consists of a housing containing therein a flexible diaphragm 34 which partitions the housing into a vacuum chamber 33 and an atmospheric chamber 32. The vacuum chamber 33 is fluidly communicated with the induction passage 31 at a point downstream of the throttle valve 30 so as to be exposed to the vacuum generated thereby. The diaphragm is operatively connected to the throttle valve 30 through a linkage indicated by 36. Hence with this arrangement as the vacuum increases in the induction passage downstream of the throttle valve the diaphragm will respond to the vacuum increase to move the throttle valve to a positon wherein an increased amount of air is permitted into the induction passage accodingly reducing the vacuum prevailing therein. Automatic maintenance of the preselected or predetermind vacuum (e.g. −100 mmHg) is thus achieved. As indicated the EGR conduct is arranged to open into the induction passage 31 at a location downstream of the throttle valve 30 so as to be exposed to the vacuum.

In addition to the just described arrangement it is possible to add, as indicated in phantom, further control means 37 which disables or induces the throttle valve to take a wide open position under predetermined modes of engine operation when EGR is not required, such as full load operation, high speed low load operation and idling. This of course facilitates the termination of the supply of EGR gas into the induction manifold under these conditions. It will be noted that this removes partial throttle in the induction system under full load condition. The control means can take the form of a solenoid clutch or the like. Although not clear from the schematic drawing the control means (in phantom) and the linkage 36 are located externally of the induction passage 31 in a well known manner.

Thus by way of summary the operation of the preferred embodiment of the present invention is as follows: As demand for power output by the engine increases, the proportioning valve 50 feeds an increased amount of hydraulic pressure to the chamber 46, driving the helical gear 19 along the rotary shaft 21. This movement in addition to the rotation to rotation translation constantly occurring between the two helical gears 18 and 19 during operation of the engine, drives the helical gear 18 to rotate through an additional degree of rotation with respect to the gear 19. Thus as the sprockets 20 and 26 rotate synchronously with the crankshaft 27 of the engine, the cam shaft 6*a* undergoes a relative rotation with respect to the cam shaft 5*a* in and this case in a sense to reduce the phase difference between the cams 5 and 6. Thus as the phase difference between the cams 5 and 6 decreases the pistons 8 and 9 tend to reciprocate toward each other simultaneously.

It will be understood that with the maximum delay between pistons 8 and 9 being urged into the cylinder 7 by the action of cams 5 and 6 respectively, the maximum period of pressure generation within the chamber 12 defined between the three pistons 8, 9 and 16 will occur. Hence piston 16 will tend to hold the inlet valve 1 open for the maximum period. However upon the phase difference between the two cams being reduced the time of pressure generation will decrease and reach a minimum value upon simultaneous reciprocation of the pistons 8 and 9. The maximum peak pressure in the chamber 12 will also occur at this time.

Thus in operation as the phase difference between the cams decreases the time for which the valve is open decreases reducing the amount of overlap of the compression phase of engine operation. Less charge is permitted to be returned to the induction passage or manifold thus increasing the amount or mass of charge retained in the combustion chamber. A proportional increase in power output is thus achieved.

It will be appreciated that the means by which the demand signal is generated is not limited to the depression of an accelerator pedal and will, in the case of an aircraft or boat, be generated via manipulation of a hand operated lever or the like. The demand signal may also be generated by a suitable electronic or hydraulic circuit if the situation demands.

Turning now to FIGS. 8 and 9A to 9C we find another embodiment of the present invention. In this case the proportioning valve 50, discussed previously in connection with FIG. 2, is connected to a hydraulic cylinder 80 in which one end of a cam shaft 84 is slidably received. As shown the cam shaft 84 carries a cam 82 which is formed with a given profile which will be discussed later in connection with FIGS. 9A to 9C. The other end of the cam shaft is slidably received in an axial bore of a sprocket or pulley 86. A spring 88 is disposed in the bore to bias the cam shaft in a direction against the bias of the hydraulic pressure prevailing in the hydraulic cylinder 80. As shown the cam shaft 84 and the sprocket 86 are splined together via splines 90 and 92 formed in the axial bore and on the end of the cam shaft 84 respectively. The sprocket 86 and the sprocket 28 (referred to in FIG. 3) driven directly by the crankshaft of the engine are operatively connected to synchronous rotation.

Figure 9A:
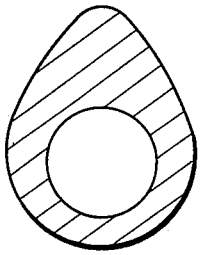
FIGS. 9A to 9C are sections taken along section lines I-I, II-II and III-III of FIG. 8, respectively.
Figure 9B:
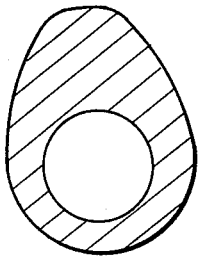
Figure 9C:
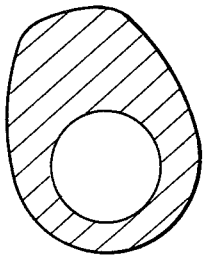

The profile of the cam 82 can best be appreciated from FIGS. 9A to 9C. FIG 9A shows a cross-section of camming having a narrow peak which induces valve lift similar to that depicted by the curve of FIG. 4 while FIG. 9C shows a cross-section of camming which induces lift similar to that shown in FIG. 5.

The operation of the second embodiment is basically the same as that of the first wherein upon increased hydraulic fluid prevailing in the hydraulic cylinder 80 the cam shaft 84 is moved axially from a first axial position in which the narrow peak cams or lifts the inlet valve, toward a second axial position in which the wide peak (FIG. 9C) lifts said valve.

Of course this arrangement can also be applied to the exhaust valve in the case it is desired to control internal EGR.

It is also possible to employ other means than the hydraulic systems set forth hereinbefore, which may take the form of solenoids or the like controlled by electronic circuits in the form of microcomputers and the like.

It is also possible to apply various pieces of apparatus, such as the valve lifting apparatus shown in FIG. 2, to applications other than internal combustion engines since the arrangement inherently has the function of adding two mechanical inputs to provide a variable output.

What is claimed is:

1. An apparatus for actuating an inlet valve associated with a combustion chamber of an internal combustion engine having an exhaust valve, the combustion chamber undergoing a volume expansion during a first phase of the engine operation and a volume contraction during a subsequent second phase of the engine operation, the valve actuating apparatus comprising:

a leading cam;

a trailing cam;

a hydraulic actuator having a hydraulic chamber, said hydraulic actuator including a first cam follower cooperating with said leading cam, a second cam follower cooperating with said trailing cam, said first and second cam followers including first and second pistons, respectively, said hydraulic actuator including a third valve tappet engaging the inlet valve, said third valve tappet including a third piston, said first, second and third pistons being reciprocally movable and defining said hydraulic chamber within said actuator, said hydraulic chamber being pressurized by reciprocation of said first and second pistons induced by rotation of said first and second cams;

a controller to vary a phase difference between said first and second cams.

2. An valve actuating apparatus as claimed in claim 1, including an exhaust cam for the exhaust valve and wherein said leading cam is in rotary unison with said exhaust cam and said trailing cam is operatively connected with said leading cam via said controller.

3. A valve actuating apparatus as claimed in claim 2, wherein said controller comprises:

a first helical gear rotatable in synchronism with said leading cam;

a second helical gear rotatable with said trailing cam and in meshing engagement with said first helical gear;

said first and second helical gears being axially movable relative to each other; and a motor to control relative axial movement between said first and second helical gears.

4. A valve actuating apparatus as claimed in claim 3, wherin said motor is operatively connected with said first helical gear for axial movement of said first helical gear relative to said second helical gear, wherein said motor moves said first helical gear axially in a direction tending to delay said trailing cam, in phase, with respect to said leading cam as demand on the engine decreases.

5. An internal combustion engine having a crankshaft comprising:

a combustion chamber;

a conduit fluidly communicating with said combustion chamber through a port;

an inlet valve for said port;

a variable valve timing system which opens said inlet valve during one phase of the engine operation and variably delays the closure of said inlet valve so as to overlap a portion of the subsequent phase of the engine operation, said variable valve timing system responding to an increase in a demand signal representing demand on the engine to reduce the degree of overlap;

said variable valve timing system comprising:

a first cam fixedly mounted on a first cam shaft;

a second cam fixedly mounted on a second cam shaft;

a cylinder;

a first piston reciprocatively received in said cylinder, said first piston having a tappet portion which follows said first cam;

a second piston reciprocatively received in said cylinder, said second piston having a tappet portion which follows said second cam;

said first and second cam shafts being arranged to rotate in synchronism with the crankshaft of the engine and with a predetermined phase difference between said first and second cams;

a third piston reciprocatively received in said cylinder, said third piston having a tappet portion engaging said inlet valve, said first, second and third pistons defining a variable volume space within said cylinder which is filed with a hydraulic fluid, the hydraulic fluid being cyclically pressurized by the reciprocation of said first and second pistons induced by the rotation of said first and second cams, respectively, to cyclically reciprocate said third piston which in turn opens and closds said inlet valve;

means for reducing the phase difference between said first and second cams in response to the magnitude of said demand signal increasing toward a maximum value thereof.

6. An internal combustion engine as claimed in claim 5, wherein said phase reducing means comprises:

a rotary shaft;

drive means interconnecting said rotary shaft and said first cam shaft to the crankshaft of the engine for synchronous rotation therewith;

a first helical gear mounted on said rotary shaft so as to be axially slidable along said rotary shaft while rotating synchronously therewith;

a second helical gear fixedly mounted on said second cam shaft, said second helical gear being in meshing engagement with said first helical gear; and means responsive to said demand signal for moving said first helical gear axially along said rotary shaft in a direction to induce a positive angular displacement of said second cam shaft with respect to said rotary shaft to cause the phase difference between said first and second cams to tend toward zero in response to the magnitude of said demand signal tending toward a maximum value thereof.

7. An internal combustion engine as claimed in claim 6, wherein said demand signal responsive means comprises:

a hydraulic pressure responsive piston reciprocatively received in a cylinder to define a hydraulic chamber;

a shift fork operatively interconnecting said hydraulic pressure responsive piston and said first helical gear whereby reciprocation of said hydraulic pressure responsive piston slides said first helical gear along said rotary shaft; and a pressure proportioning valve which proportions the hydraulic pressure fed to said hydraulic pressure responsive piston from a source of hydraulic fluid under pressure in response to said power demand signal.

8. An internal combustion engine as claimed in claim 5, further comprising:

an exhaust gas recirculation conduit through which a portion of exhaust gas can flow from the exhaust conduit of the engine to said conduit;

means for maintaining a predetermined vacuum in said conduit for facilitating the recirculation of the exhaust gas.

9. An internal combustion engine as claimed in claim 8, further comprising:

means for temporarily disabling said predetermined vacuum maintaining means to obviate said predetermined vacuum under predetermined modes of operation of the engine for facilitating the termination of the exhaust gas recirculation under said predetermined modes of operation of the engine.

10. A variable valve timing system for an internal combustion engine having a crankshaft, comprising:

first and second cams fixedly mounted on first and second cam shafts respectively, said first and second camshafts being arranged to rotate in synchronism with the crankshaft of said engine and with a predetermined phase difference between said cams;

a cylinder which reciprocatively receives therein first, second and third pistons, which pistons therebetween define a closed variable-volume chamber within said cylinder, which chamber is filled with a working fluid, said first and second pistons respectively engaging said first and second cams to be reciprocatively driven thereby to cyclically pressurize said working fluid to in turn reciprocatively drive said third piston; and means for reducing the phase difference between said first and second cams in response to the magnitude of a control signal increasing toward a maximum valve thereof.

11. A variable valve timing system as claimed in claim 10, wherein said phase reducing means comprises:

a rotary shaft;

drive means interconnecting said rotary shaft and said first cam shaft to the crankshaft of the engine for synchronous rotation therewith;

a first helical gear mounted on said rotary shaft so as to be axially slidable along said rotary shaft while rotating synchronously therewith;

a second helical gear fixedly mounted on said second cam shaft, said second helical gear being in meshing engagement with said first helical gear; and means responsive to said control signal for moving said first helical gear axially along said rotary shaft in a direction to induce a positive angular displacement of said second cam shaft with respect to said rotary shaft to cause the phase difference between said first and second cams to tend toward zero in response to the magnitude of said control signal increasing toward a maximum value thereof.

12. A variable valve timing system as claimed in claim 11, wherein said control signal responsive means comprises:

a hydraulic pressure responsive piston reciprocatively received in a cylinder to define a hydraulic chamber;

a shift fork operatively interconnecting said hydraulic pressure responsive piston and said first helical gear whereby reciprocation of said hydraulic pressure responsive piston slides said first helical gear along said rotary shaft; and a pressure proportioning valve which proportions the hydraulic pressure fed to said hydraulic pressure responsive piston from a source of hydraulic fluid under pressure in response to said control signal.

13. A variable valve timing system as claimed in claim 10, wherein said engine has a combustion chamber;

a conduit communicating with said combustion chamber; and a valve for controlling said communication between said combustion chamber and said conduit, said valve being adapted to be opened by said third piston, and wherein said variable valve timing system opens said inlet valve during one phase of engine operation and variably delays the closure of said valve so as to overlap a portion of a subsequent phase of engine operation, said system responding to an increase in the magnitude of said control signal to reduce the degree of overlap, whereby the mass of fluid retained in said combustion chamber can be controlled.

14. A variable valve timing system as claimed in claim 13, wherein said conduit is an unthrottled induction conduit and said valve is an inlet valve.

15. A variable valve timing system as claimed in claim 14, wherein said engine further comprises:

an exhaust gas recirculation conduit through which a portion of exhaust gas can flow from an exhaust conduit of the engine to said conduit; and means for maintaining an essentially constant predetermined vacuum in said conduit, which predetermined vacuum inducts exhaust gas from said exhaust gas recirculation conduit into said conduit.

16. A variable valve timing system as claimed in claim 15, wherein said engine further comprises:

means for temporarily disabling said predetermined vacuum under predetermined modes of operation of the engine for facilitating the termination of the exhaust gas recirculation under said predetermined modes of operation of the engine.

* * * * *